US006394271B1

(12) United States Patent
Vallve et al.

(10) Patent No.: US 6,394,271 B1
(45) Date of Patent: May 28, 2002

(54) ANTI-ROTATIONAL SYSTEM

(75) Inventors: Raimundo Roca Vallve; Francisco Guerrero Mercado; Juan Ruiz Estrella; Andres Alvarez Vargas; Raul Gonzalez Alonso; Martin Cisneros Aguirre; Alfredo Cruz Cruz, all of San Juan del Rio (MX)

(73) Assignee: Plasticos Tecnicos Mexicanos, S.A. de C.V., San Juan del Rio (MX)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/227,880

(22) Filed: Jan. 11, 1999

Related U.S. Application Data

(63) Continuation of application No. 09/127,803, filed on Aug. 3, 1998, now Pat. No. 6,041,927.

(30) Foreign Application Priority Data

Mar. 2, 1998 (MX) ..... 980170

(51) Int. Cl.[7] ..... B65D 71/00

(52) U.S. Cl. ..... 206/427; 220/509

(58) Field of Search ..... 206/427, 433, 206/203; 220/516, 517, 518, 519, 509

(56) References Cited

U.S. PATENT DOCUMENTS

| | | | | | |
|---|---|---|---|---|---|
| 3,998,328 | A | * | 12/1976 | Box | 220/516 X |
| 4,585,137 | A | * | 4/1986 | Poutiainen et al. | 220/518 |
| 4,911,300 | A | * | 3/1990 | Colonna | 206/427 |
| 5,702,022 | A | * | 12/1997 | Umiker | 220/518 |
| 6,041,927 | A | * | 3/2000 | Vallve et al. | 206/427 |

* cited by examiner

*Primary Examiner*—Bryon P. Gehman
(74) *Attorney, Agent, or Firm*—Oblon, Spivak, McClelland, Maier & Neustadt, P.C.

(57) ABSTRACT

An anti-rotational system which restrains containers therein from rotating and contacting adjacent containers so as not to abrade the outer surface of the containers features an exterior box having at least one wall having a height at least as great as a height of the containers and a bottom structure. Furthermore, a plurality of pockets are formed within the exterior box structure. Each pocket has a rigid portion and an elastic portion. The rigid portion engages a maximum diameter of the container. The elastic portion flexes so as to allow the maximum diameter region of the container to pass thereby. Once the maximum diameter region of the container has passed by the elastic region, the elastic characteristics of the elastic region allows the elastic region to flex back towards its original position thus ensuring that the elastic portion contacts a smaller diameter of the container. Such secure retention of the container in the anti-rotational box prevents the container stored in the anti-rotational box from contacting each other and therefore abrading the outer surfaces of the container. As such, the containers stored and transported in such an anti-rotational box allows the containers to be refilled and reused. Another embodiment features the use of thickened wall ribs so as to make more rigid the anti-rotational system so that the full-depth walls do not warp. The thickened wall ribs connect to the wall of the exterior box structure, the bottom structure of the exterior box structure and a pocket formed within the interior of the exterior box structure. The use of the thickened wall ribs increases the number times a container can be re-used.

18 Claims, 10 Drawing Sheets

ANTI-ROTATIONAL SYSTEM

This application is a continuation application of parent application Ser. No. 09/127,803, filed Aug. 3, 1998 now U.S. Pat. No. 6,041,927. This application also claims priority from Mexican Patent Application No. 980170 which is hereby incorporated by reference.

BACKGROUND OF THE INVENTION

1. Field of the Invention

This invention concerns a system for the storage of containers such as bottles. The invention more particularly concerns the retention of the bottles within a box so that the bottles do not rotate or contact each other which would result in the abrasion of the outer surface of the bottles. Such abrasions on the surface of the bottles render the bottles unusable for reuse.

2. Discussion of the Background

Previously existing systems or boxes for the storage of bottles, which are used to store the bottles or to transport the bottles from one location to another, have a number of shortcomings which result in the bottle being abraded on its outer surface. Such abrasions render the bottle unusable for refilling for reuse. Ideally, the boxes that hold the bottles would be capable of retaining in a single location each of the bottles so that the bottles do not contact each other.

Known prior art devices (Apps et. al., U.S. Pat. Nos. 5,405,042 and 5,320,245, both of which are incorporated herein by reference) provide dividers which are insertable into a box so that the bottles can be handled. The prior art discloses that different dividers can be inserted into the box so as to accommodate bottles of different sizes within one type of box. However, the boxes of the prior art allow the bottles arranged by the dividers to contact each other causing abrasions on the outer surfaces.

Another problem encountered in the prior art arises when many boxes are placed one on top of another. The box at the bottom of the pile of boxes supports the weight of the boxes and bottles above it through its side walls. In such a case, the side walls tend to warp outward. Such warpage tends to loosen the fit of the bottles situated in the box located at the bottom of the pile of boxes, thus causing the bottles to move about and to contact one another, where such contact causes abrasions on the surface of the bottles. Therefore, the bottles become unusable for refilling due to the abrasions. Ideally, the boxes that hold the bottles would be capable of supporting the weight of many boxes filled with bottles stacked above it, so that the box located at the bottom of the pile of boxes would be capable of retaining in a single location each of the bottles so that the bottles do not contact each other.

Thus, there is a need for a system, such as a box, which stores containers, such as bottles, that prevents the bottles from contacting each other during storage and transportation.

SUMMARY OF THE INVENTION

It is an object of the invention to provide a system which stores containers that prevents the containers from contacting each other's outer surfaces.

In one form of the invention the anti-rotational system takes the form of an exterior box having at least one full-depth wall having a height at least as great as a height of the containers and having a bottom structure. Formed within the exterior box structure are located pockets which retain the containers in the box. The pockets include a substantially rigid portion and an elastic portion. The substantially rigid portion engages a maximum diameter of the container and the elastic portion engages a diameter of the container which is smaller than the maximum diameter of the container with sufficient force so as to retain the container in the box. The containers have non-uniform diameters.

In yet another form of the invention, the anti-rotational system takes the form of an anti-rotational box, similar to the anti-rotational box described above, where containers having a uniform diameter are securable within the pockets formed in the exterior box.

In still yet another form of the invention, the anti-rotational system takes the form of a general structural piece, such as a shelf, having pockets wherein containers are securable.

In another form of the invention, the anti-rotational system includes reinforcement or thickened wall ribs connected to the full-depth walls, to the bottom structure and to portions of the structure forming the pockets.

Thus, Applicant's invention is superior to the prior art. Applicant's invention provides an anti-rotational system that prevents the inserted containers from rotating and contacting adjacent containers. Therefore, the containers can be refilled for reuse since the design on the outer surface is still identifiable. Thus, the reuse of the containers results in a cost savings and, also, results in conservation of natural resources. Such structural features distinguish Applicant's invention, structurally and functionally, over the prior art.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
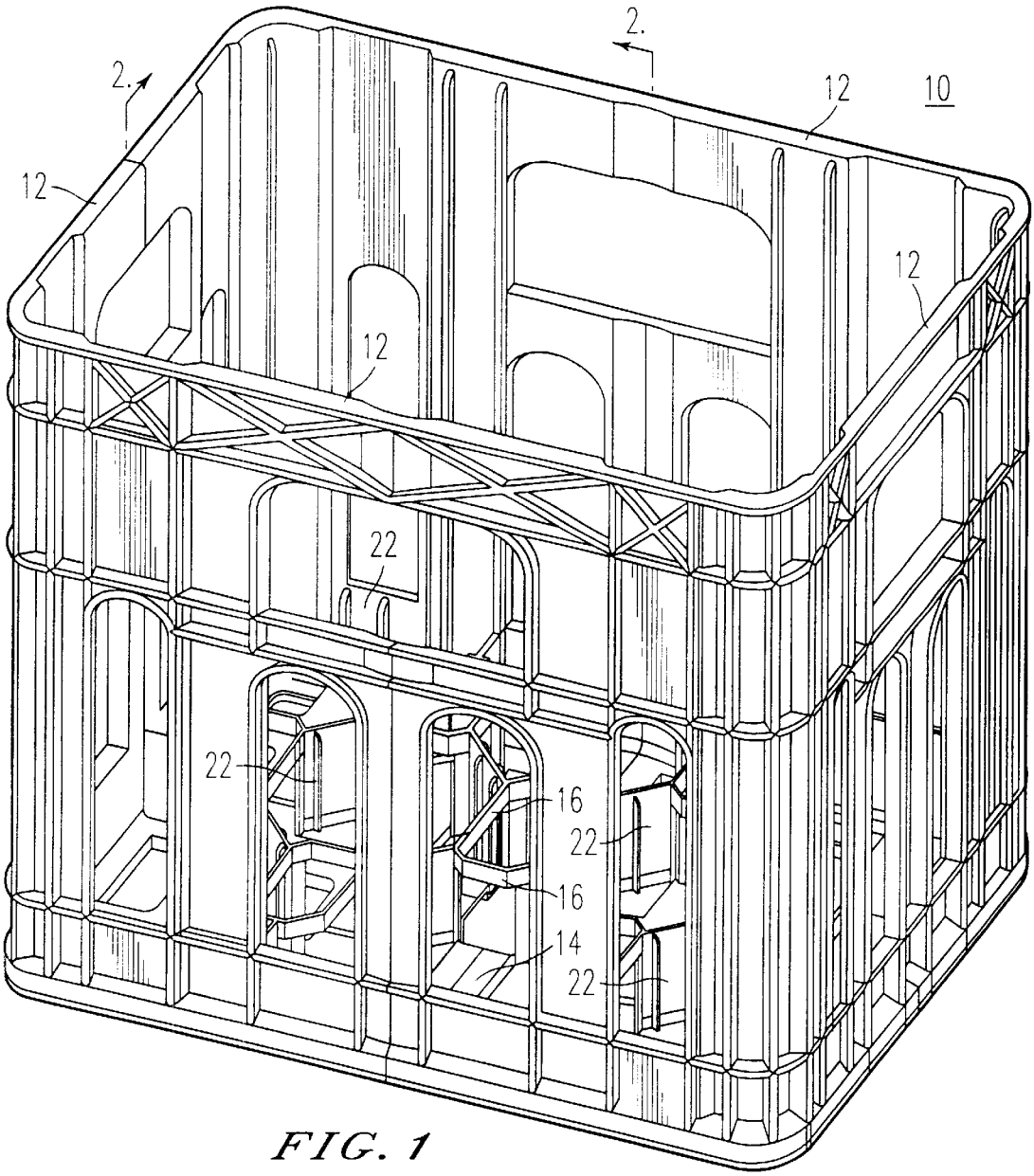
FIG. 1 is a perspective view of an anti-rotational box.

Referring now to the drawings, wherein like reference numerals designate identical or corresponding parts throughout the several views, and more particularly to FIG. 1 thereof, an anti-rotational box 10 has been created which provides for the anti-rotation of containers, such as bottles, inserted therein, which provides for abrasion resistance on the surfaces of the bottles due to rubbing of the bottles against adjacent bottles. The embodiment of this invention is displayed in FIGS. 1–6. FIG. 1 is a perspective view of the anti-rotational box 10 showing the full-depth walls 12 and the bottom structure 14.

Figure 2:
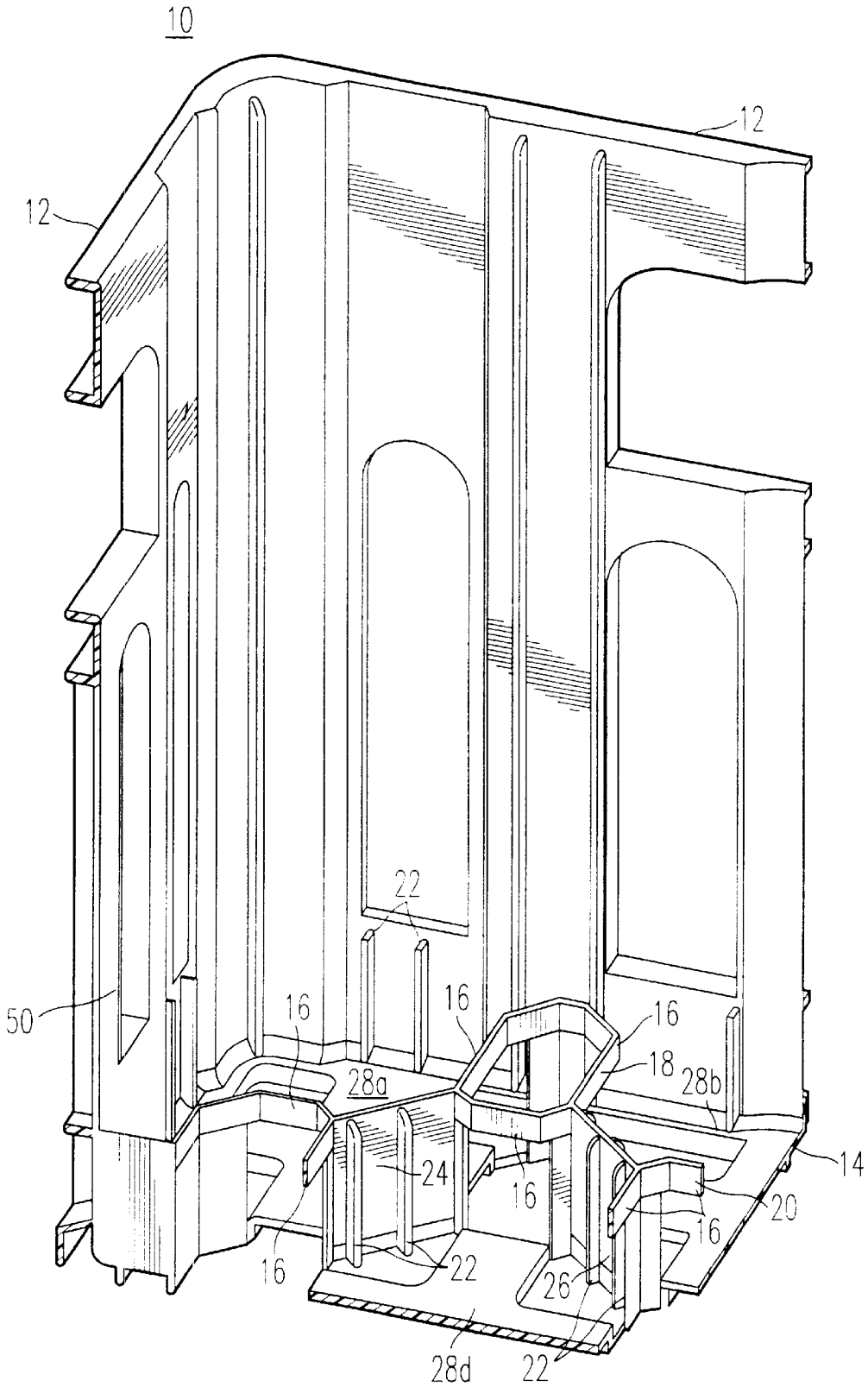
FIG. 2 is a partial perspective cross-sectional view taken along the line 2—2 of FIG. 1.

FIG. 2 is a partial perspective cross-sectional view taken along line 2—2 of FIG. 1. FIG. 2 shows the placement of the full-depth walls 12, the bottom structure 14, the longitudinal ribs 16, pairs of perpendicular ribs 22, pocket 28*a* and parts of pockets 28*b* and 28*d* formed by the periphery of the connection between the longitudinal ribs 16 and the pairs of perpendicular ribs 22. The pairs of perpendicular ribs 22 are substantially located between the bottom structure 14 and the longitudinal ribs 16.

Figure 3:
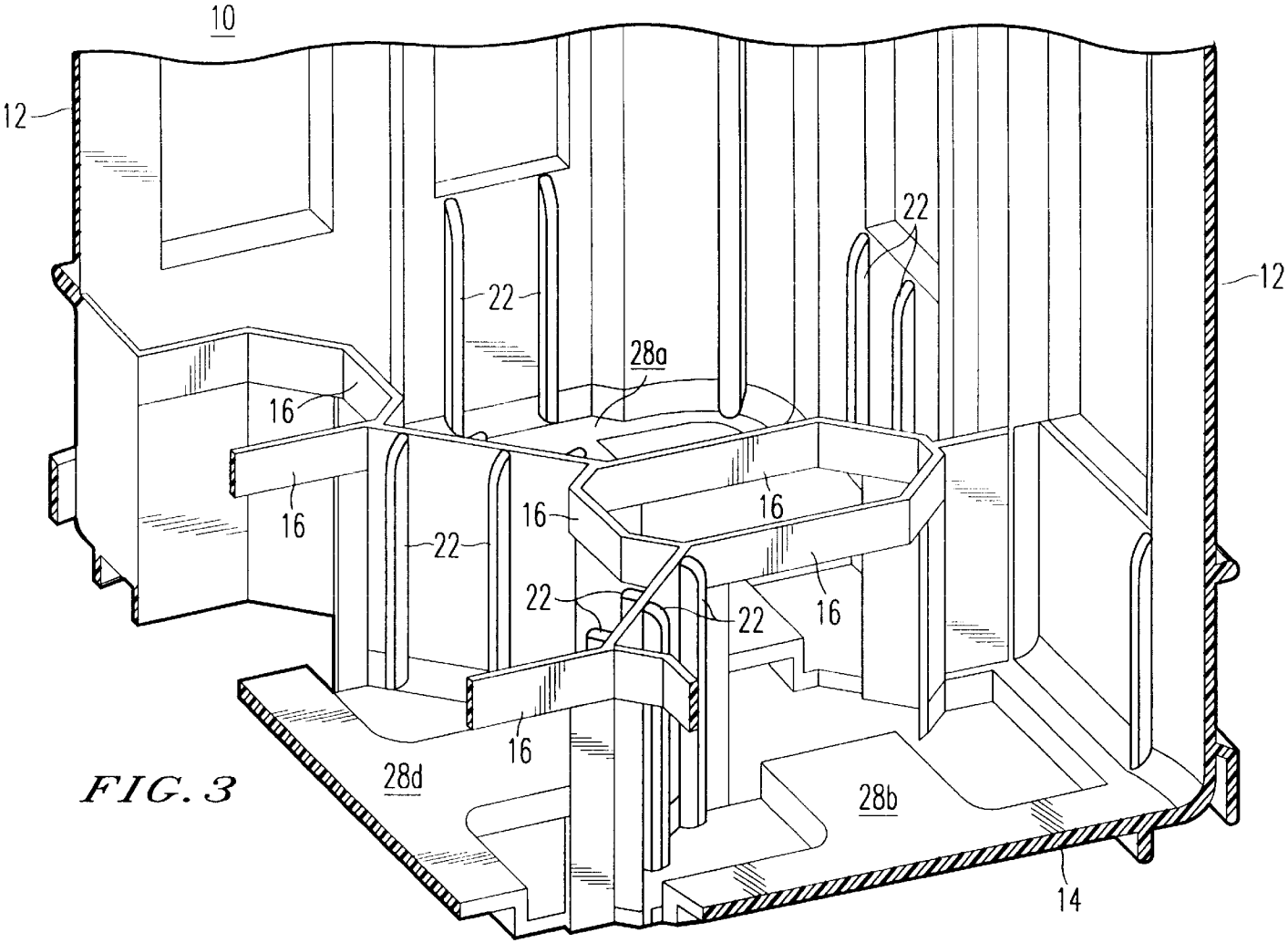
FIG. 3 is an enlarged partial perspective cross-sectional view of the cross-section of FIG. 2 taken from another angle.

FIG. 3 is a partial perspective cross-sectional view taken at an angle near the bottom of the cross-section shown in FIG. 2. Shown in FIG. 3 are the placement of the full-depth walls 12, the bottom structure 14, and the placement of the longitudinal ribs 16 and the pairs of perpendicular ribs 22 to form the pockets 28*a*, 28*b* and 28*d*. As shown in FIGS. 2–5, the longitudinal ribs 16 are oriented parallel to the longitudinal plane of the bottom structure 14. Also as shown in FIGS. 2–6, opposing longitudinal ribs 16 form first sets of longitudinal ribs 18 and pairs of longitudinal ribs transverse to the first pair form a second set of longitudinal ribs 20. The pairs of perpendicular ribs 22 are used to form a first set of pairs of perpendicular ribs 24. Two more sets of pairs of perpendicular ribs 22 form second sets of perpendicular ribs 26 which are oriented substantially transverse to the first set of pairs of perpendicular ribs 24. Each pair of perpendicular ribs 22 substantially faces towards a center of a container 30 contained in any one of the pockets 28*a*–28*h*.

Figure 4:
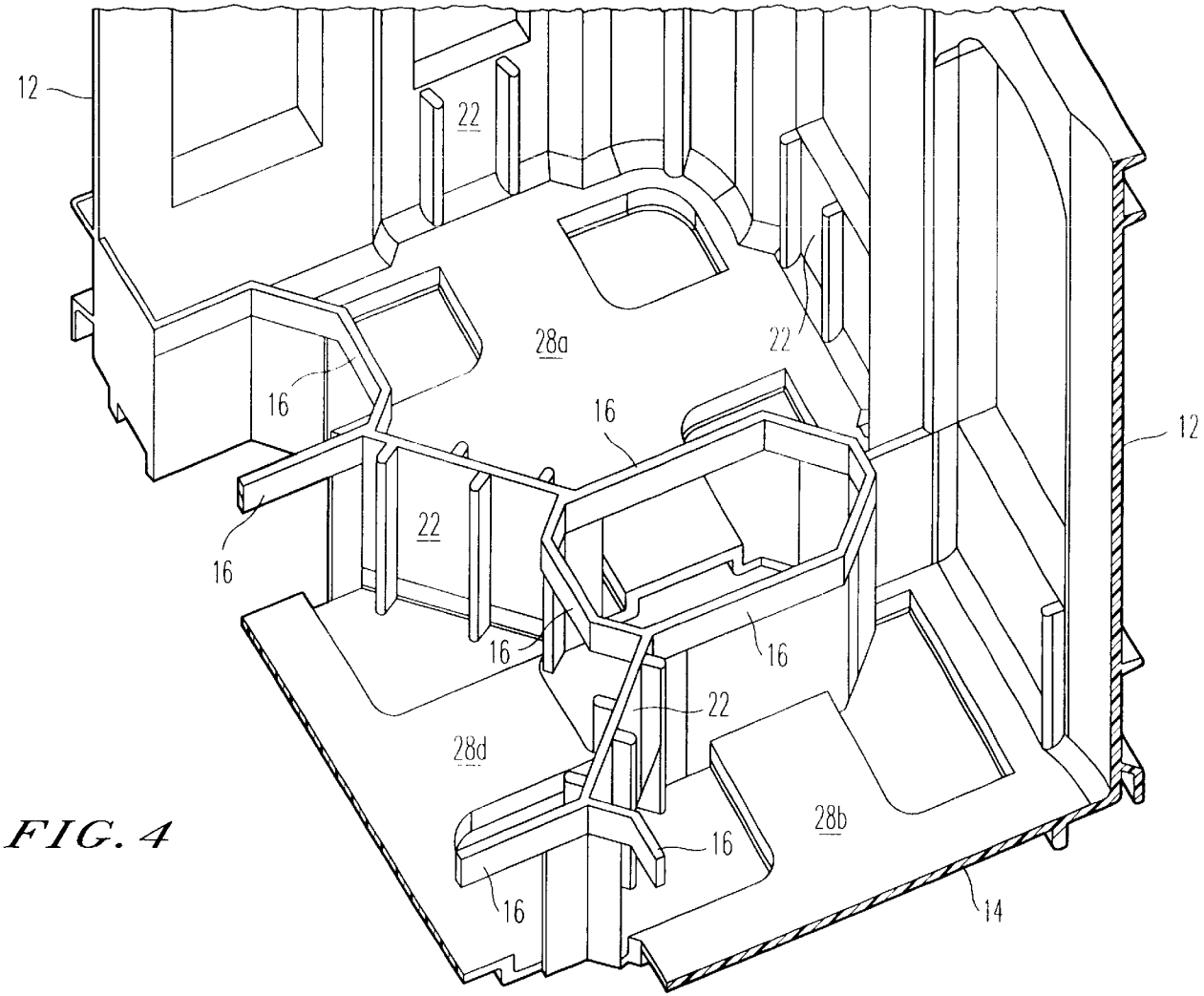
FIG. 4 is an enlarged partial perspective cross-sectional view of the cross-section of FIG. 2 taken from another angle.

FIG. 4 is a partial perspective cross-sectional view taken at an angle near the bottom of the cross-section shown in FIG. 2 showing the features of the invention.

Figure 5:
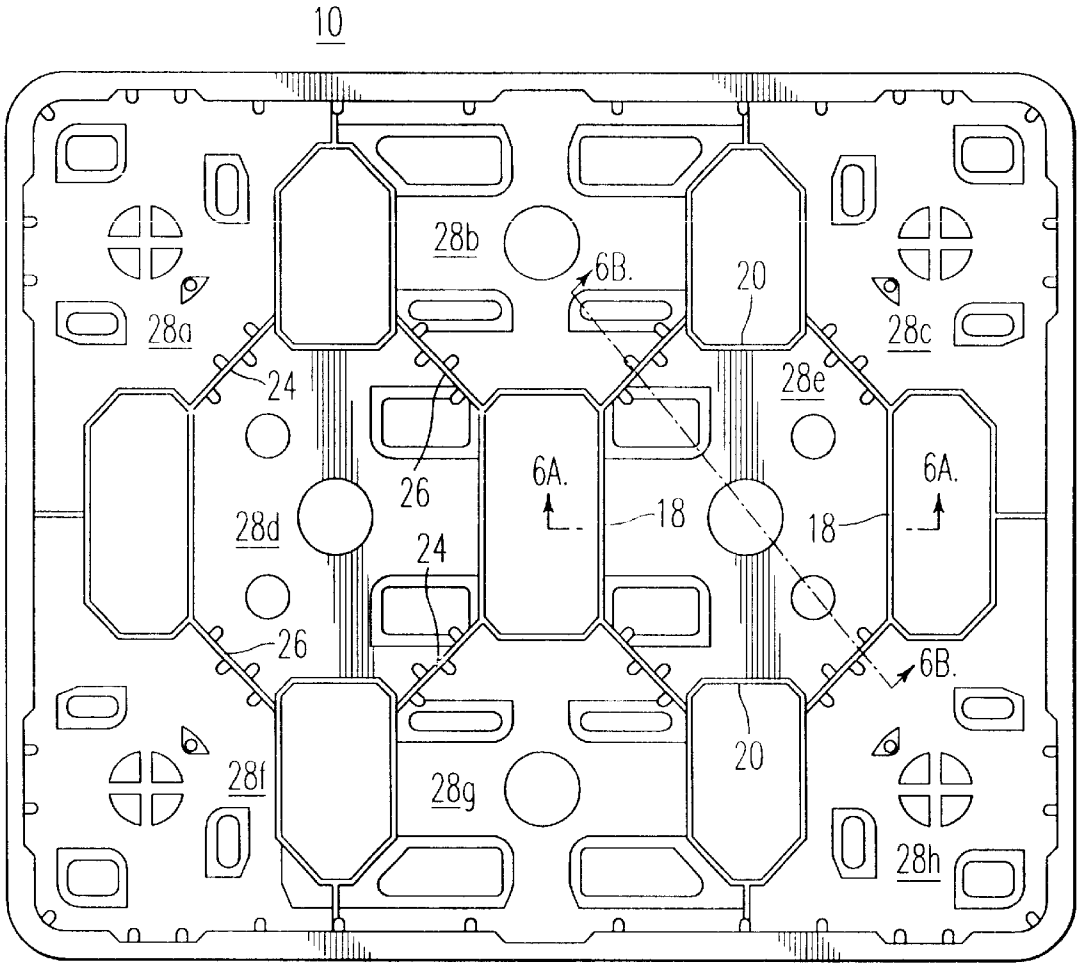
FIG. 5 is a top view of the anti-rotational box.
Figure 6A:
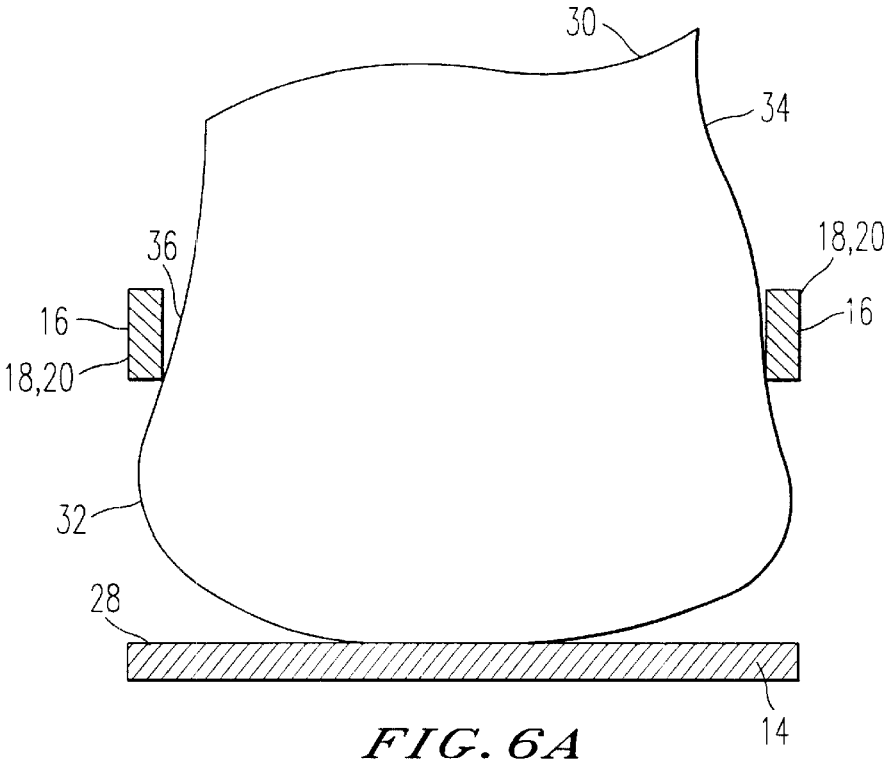
FIGS. 6A and 6B are partial cross-sections of a pocket of the anti-rotational box with a container inserted taken along lines 6A—6A and 6B—6B, respectively, of FIG. 5.
Figure 6B:
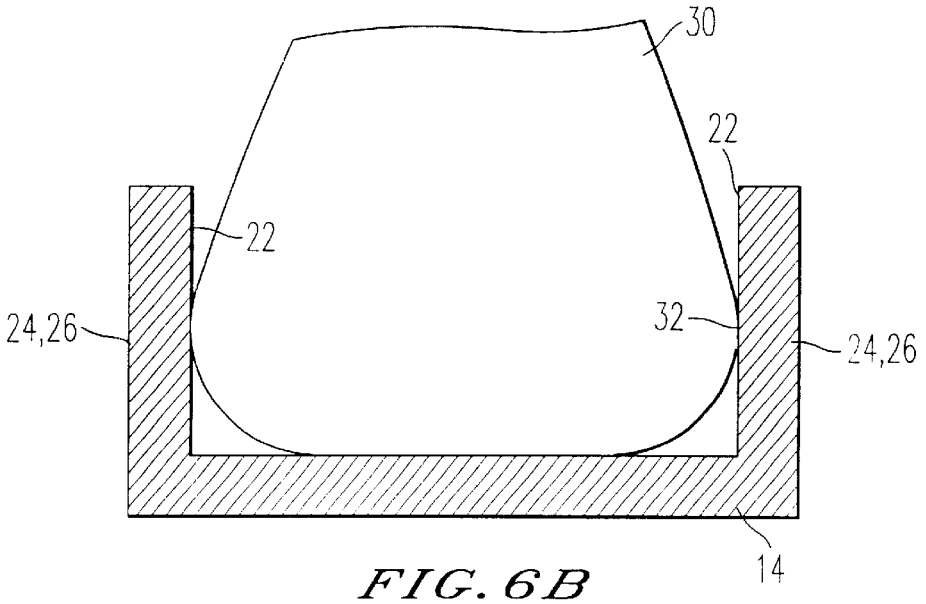

FIG. 5 is a top view of the anti-rotational box 10 showing pockets 28*a*–28*h*. FIGS. 6A and 6B are partial cross-sectional view through pocket 28*e* as shown in FIG. 5.

FIGS. 6A and 6B show the interaction between a container 30 and pocket 28*e* of the anti-rotational box 10. The cross-section illustrated in FIG. 6B is located approximately forty-five degrees to the cross-section of illustrated in FIG. 6A. FIG. 6A shows the container 30 and its interaction with the longitudinal ribs 16. Furthermore, the opposing, parallel pairs of longitudinal ribs 16 can exemplify either one of the first and second sets of longitudinal ribs 18, 20, as shown in FIG. 6A. FIG. 6B shows the container 30 and its interaction with the pairs of perpendicular ribs 22. Additionally, the opposing, parallel sets of pairs of perpendicular ribs 22 can exemplify either one of the first and second sets of pairs of perpendicular ribs 24, 26, as shown in FIG. 6B.

The anti-rotational box 10 is molded as a single structure. The height of the full-depth walls 12 of the anti-rotational box 10 are long enough to fully cover the height of the container 30 inserted therein. Such depth provides that multiple anti-rotational boxes 10 may be stacked on top of each other or cross stacked atop each other. The anti-rotational box is preferably made of a polymeric material. The difference in distance between the maximum diameter 32 of the container 30 and the length between the set of longitudinal ribs 18, 20 is such that when the container 30 is inserted into the anti-rotational box 10 the longitudinal ribs 18, 20 elastically press against the container 30. The difference in distance between the maximum diameter 32 of the container 30 and the length between the sets of pairs of perpendicular ribs 24, 26 is such that when the container 30 is inserted into the anti-rotational box 10 the perpendicular ribs 24, 26 press against the container 30. The container 30 is preferably made of PET. The container contains two liters of fluid. However, the invention can be used with any size of container.

In operation a container 30 is inserted into any one of the pockets 28*a*–28*h*. For illustrations purposes assume pocket 28*d* or 28*e* is the pocket into which the container 30 is inserted. The container has a non-uniform diameter forming a waist. The container 30 has a maximum diameter 32, a minimum diameter 34, and a transition region 36 which is located in between the maximum and minimum diameters, as shown in FIGS. 6A and 6B. The maximum diameter 32 of the container 30 is first introduced past the longitudinal ribs 16. The spacing between opposing longitudinal ribs 16 of a pocket 28*d* or 28*e* are such that the maximum diameter 32 of the container 30 tends to elastically deform the longitudinal ribs 16 outward. Upon further insertion of the container 30 into the pocket 28*d* or 28*e* the longitudinal ribs 16, due to their elastic nature, tend to return towards their initial position as the longitudinal ribs 16 come into contact with the transition region 36 of the container 30 which has a diameter smaller than that of the maximum diameter 32. As the maximum diameter 32 of the container 30 proceeds past the longitudinal ribs 16 the maximum diameter 32 of the container 30 comes into contact with the pairs of perpendicular ribs 22. Opposing pairs of perpendicular ribs 24, 26 are dimensioned a distance from each other so that the maximum diameter 32 of the container 30 contacts the pairs of perpendicular ribs 22. Together, both opposing pairs of perpendicular ribs 24, 26 form a substantially rigid portion. Together, both opposing pairs of first and second longitudinal ribs 18, 20 form an elastic portion. Once the container 30 is fully inserted into the pocket 28*d* or 28*e* the pairs of perpendicular ribs 22 of the first and second sets of pairs of perpendicular ribs 24, 26, and the longitudinal ribs 16 of the first and second sets of longitudinal ribs 18, 20 are in contact with the surface of the bottle 30 at the maximum diameter 32 and at the transition region 36, respectively. The container 30 is securely supported by the anti-rotational box 10. The container 30, as secured above, does not rotate nor does it lean sufficiently so as to contact adjacent containers. Therefore, the surfaces of adjacent containers 30 do not touch and as such the adjacent surfaces of the containers 30 do not abrade each other. As such, the containers 30 may be refilled and reused.

The comer pockets 28*a*, 28*c*, 28*f* and 28*h* function in a manner similar to that of pockets 28*d* and 28*e*. As shown in FIGS. 2–5, the comer pockets 28*a*, 28*c*, 28*f* and 28*h* each have two longitudinal ribs 16 oriented approximately ninety degrees to each other, and each corner pocket has three parallel sets of pairs of perpendicular ribs 22. Two of the three sets of pairs of perpendicular ribs 22 are oriented approximately ninety degrees to each other. The third set of the three sets of perpendicular ribs 22 being oriented approximately forty-five degrees away from being perpendicular to the other two sets of pairs of perpendicular ribs 22. As discussed above, the longitudinal ribs 16 are dimensioned so as to elastically deform so as to enable the container to pass-by the longitudinal ribs 16 as the container is secured within the pocket and, as such, the longitudinal ribs 16 form an elastic portion. Also, as described above, the pairs of perpendicular ribs 22 are dimensioned so as to be substantially rigid and, as such, the pairs of perpendicular ribs 22 form a substantially rigid portion. The action of the longitudinal ribs 16 and the pairs of perpendicular ribs 22 is such that once the container is fully inserted into one of the corner pockets 28*a,* 28*c,* 28*f* or 28*h* the container 30 does not rotate and does not contact adjacent containers so that the containers 30 can be refilled and reused.

The side pockets 28*b* and 28*g* function in a manner similar to that of pockets 28*a,* 28*c*–28*f* and 28*h,* as described above. As shown in FIGS. 2–5, the side pockets 28*b* and 28*g* each have three longitudinal ribs 16, where two of the three longitudinal ribs 16 are oriented approximately parallel to each other and the third of the three longitudinal ribs 16 is oriented approximately perpendicular to the other two longitudinal ribs 16, and each side pocket has three parallel sets of pairs of perpendicular ribs 22, where two of the three parallel sets of pairs of perpendicular ribs 22 are oriented approximately ninety degrees to each other. The third set of the three sets of perpendicular ribs 22 being oriented approximately forty-five degrees away from being perpendicular to the other two sets of pairs of perpendicular ribs 22. As discussed above, the longitudinal ribs 16 are dimensioned so as to elastically deform so as to enable the container to pass-by the longitudinal ribs 16 as the container 30 is secured within the pocket and, as such, the longitudinal ribs 16 form an elastic portion. Also, as described above, the pairs of perpendicular ribs 22 are dimensioned so as to be substantially rigid and, as such, the pairs of perpendicular ribs 22 form a substantially rigid portion. The action of the longitudinal ribs 16 and the pairs of perpendicular ribs 22 is such that once the container is fully inserted into one of the side pockets 28*b* or 28*g* the container 30 does not rotate and does not contact adjacent containers so that the containers 30 can be refilled and reused.

Testing has determined that containers stored and transported in boxes of the prior art, without the anti-rotational system, can be reused approximately eight times before the containers are rendered useless. However, the results of testing show that containers stored and transported in the first embodiment of the anti-rotational system can be reused approximately twenty times.

Furthermore, one of ordinary skill in the art would be able to use the invention of the pocket configuration 28*a*–28*h* of the anti-rotational system in a structure, such as a shelf, to secure containers therein, while the containers are stored and/or displayed. The invention of the anti-rotational system can also be used to secure containers having a single diameter along the length of the container's body.

When the anti-rotational box 10, or any box of the prior art, is located at the bottom of a stack of boxes, the anti-rotational box 10 located at the bottom of the pile of boxes supports the weight (vertical load) of the boxes above it and it supports the weight of the containers, whether the containers are filled or not filled. The vertical load tends to cause the full-depth walls 12 to warp, bulge, flex, or buckle outward. The warpage causes the containers secured inside the anti-rotational box 10 to become unsecured, thus causing adjacent containers to contact one another resulting in abrasions of their surfaces.

Figure 7:
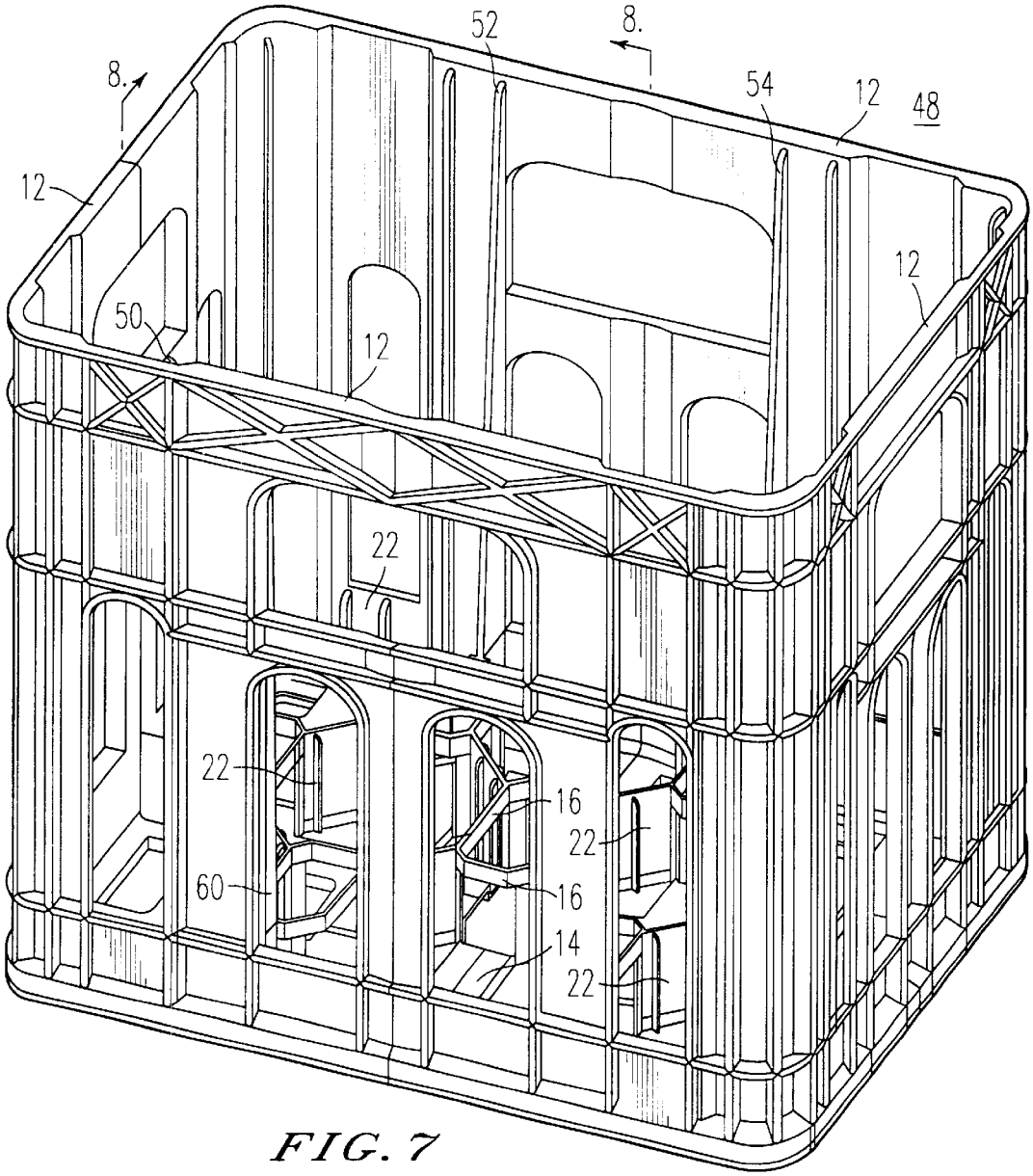
FIG. 7 is a perspective view of another embodiment of the anti-rotational system in the form of a box.

A second embodiment of the invention, which is preferably used in conjunction with the first embodiment, is displayed in FIGS. 7–10. FIG. 7 is a perspective view of an anti-rotational box 48 which provides for the anti-rotation of containers, such as bottles, inserted therein, which provides for abrasion resistance on the surfaces of the bottles due to rubbing of the bottles against adjacent bottles, while the anti-rotational box 48 is subjected to large vertical loads transmitted through the full-depth walls 12. The vertical loads are created when many boxes are stacked one on top of another. Such stacking of the anti-rotational boxes 48 occurs in warehouses and in trucks during storage and transport of the containers. Like reference numerals designate identical or corresponding parts throughout FIGS. 1–10, and as such a description of previously described features is not provided.

In order to prevent the above-described warpage of the full-depth walls 12 which are subject to the large vertical load that results in the abraded surfaces of the containers, multiple thickened wall ribs 50, 52, 54, 56, 58 and 60 are attached along the vertical length of the inner surface of the full-depth walls 12, as shown in FIGS. 7–10. Thickened wall ribs 50, 52, 54, 56, 58 and 60 reinforce the full-depth side walls 12 which adds rigidity to the overall structure of the anti-rotational box 48.

Figure 8:
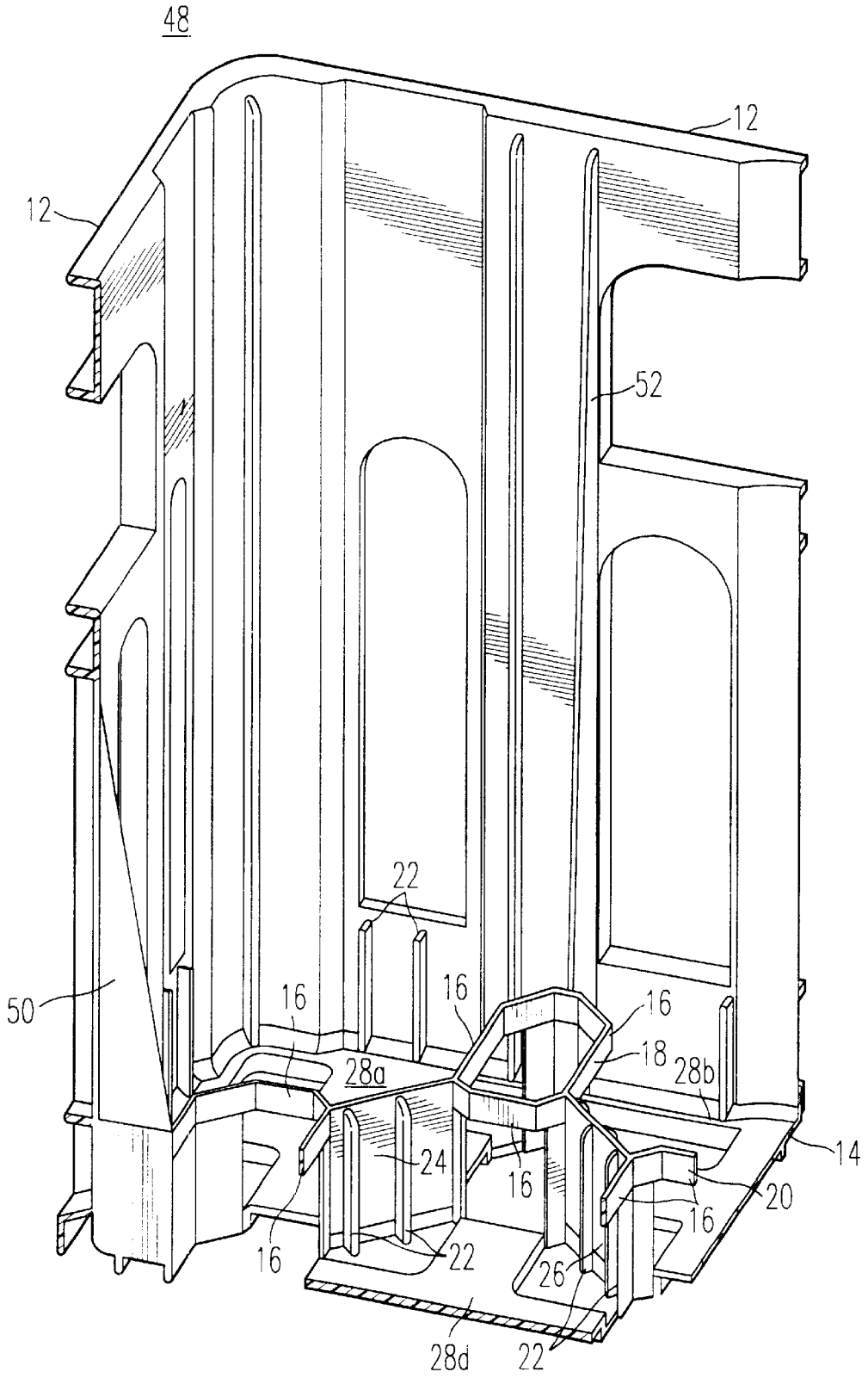
FIG. 8 is a partial perspective cross-sectional view taken along line 8—8 of FIG. 7.

FIG. 8 is a partial perspective cross-sectional view taken along line 8—8 of FIG. 7. FIG. 8 shows the placement of two of the thickened wall ribs 50, 52 connected to the full-depth walls 12, the bottom structure 14 and to material that form the pockets 28*a*–28*h*. Thickened wall rib 52 has a small width near a free edge of the full-depth wall 12 and tapers to a large width where thickened wall rib 52 meets the material which forms the pockets 28*a*–28*h*. Thickened wall rib 50 tapers in a manner similar to that of thickened wall rib 52, however, thickened wall rib 50 has a small width near an open section, such as a handle, as shown in FIG. 8.

Figure 9:
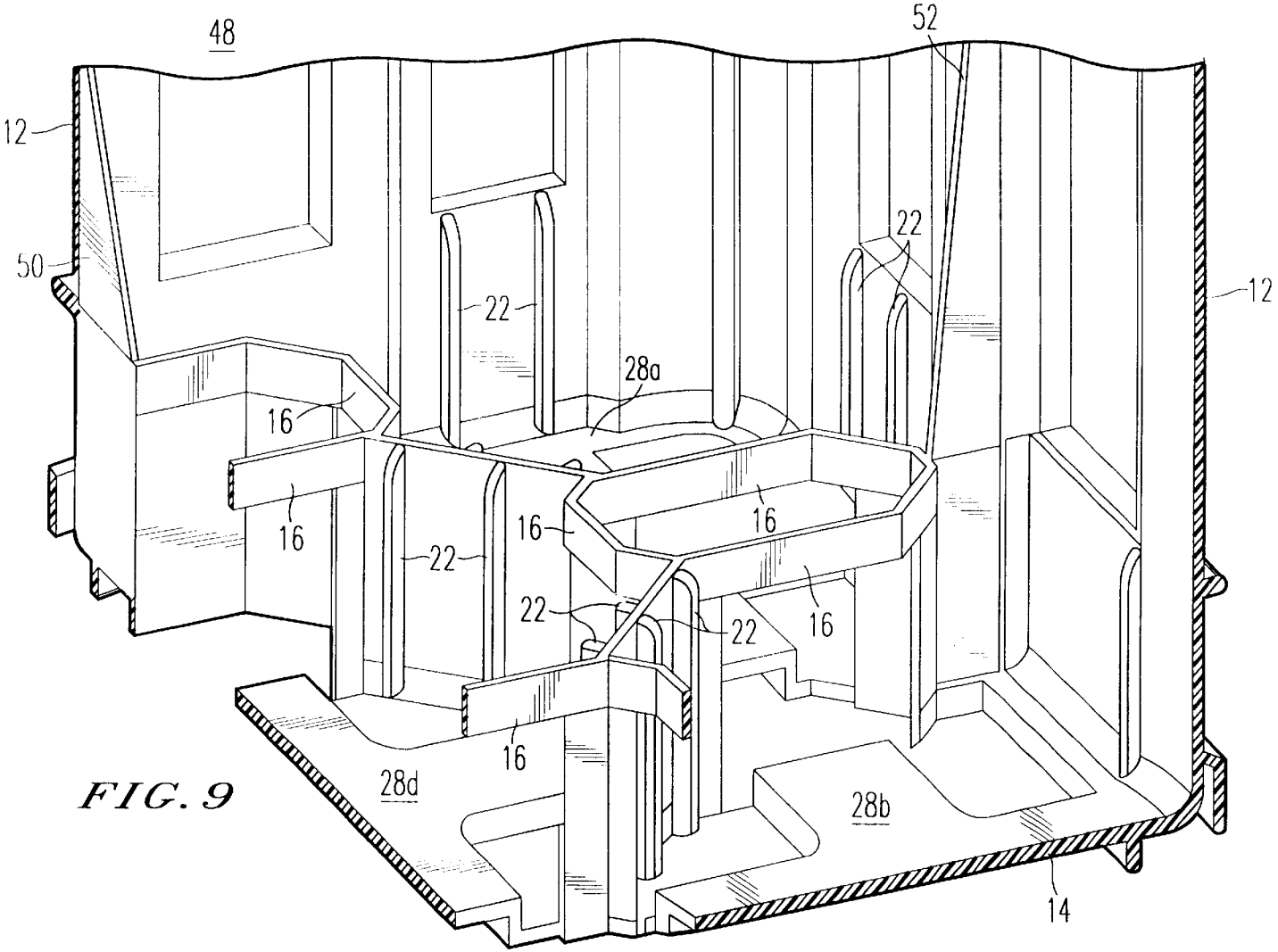
FIG. 9 is an enlarged partial perspective cross-sectional view of the cross-section of FIG. 8 taken from another angle.

FIG. 9 is a partial perspective view taken at an angle near the bottom of the cross-section shown in FIG. 8. Shown in FIG. 9 are the placement of the thickened wall ribs 50, 52. Thickened wall rib 56 is shaped similarly to thickened wall rib 50. Thickened wall ribs 54, 58 and 60 are shaped similarly to thickened wall rib 52. Placement of the remaining thickened wall ribs 54, 56, 58 and 60 are symmetrically located about the anti-rotational box 48.

Figure 10:
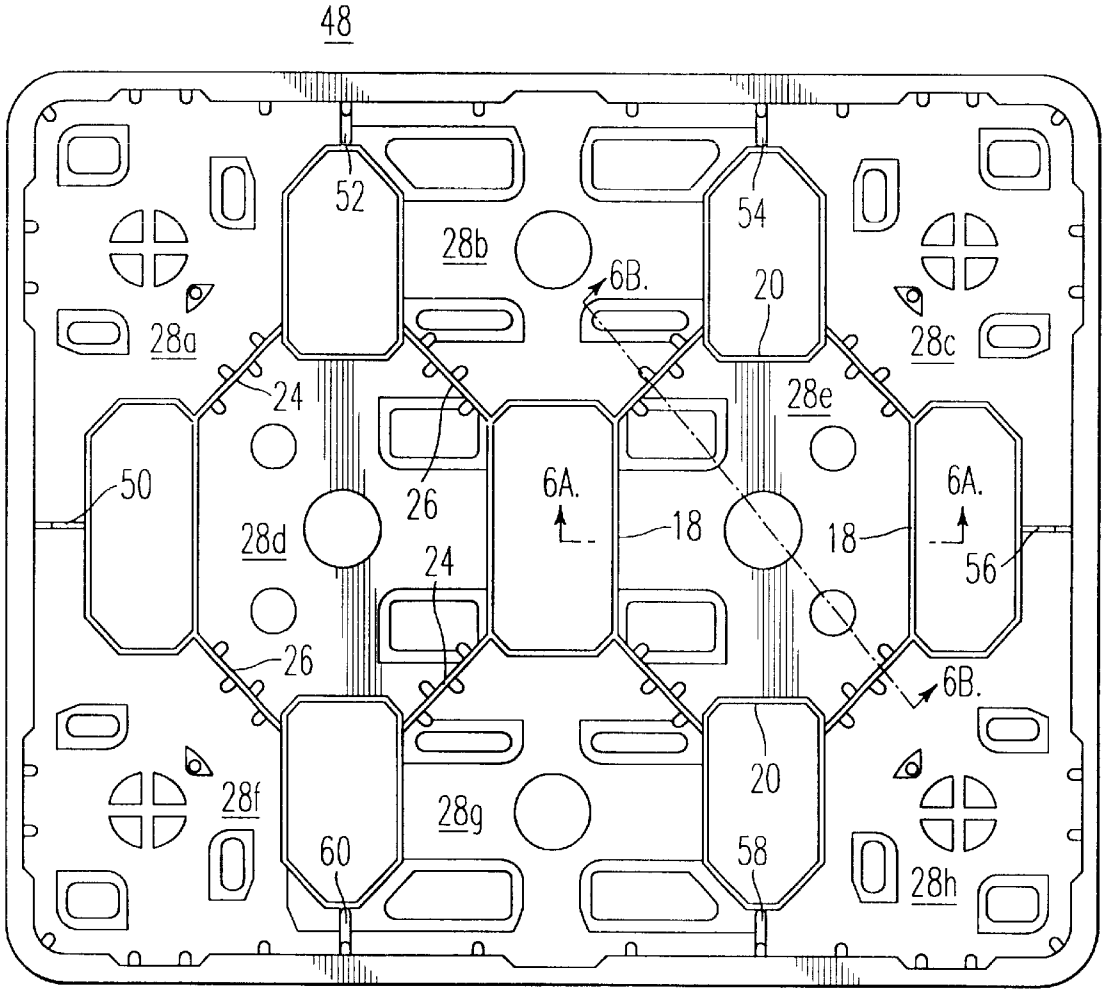
FIG. 10 is a top view of the second embodiment of the anti-rotational system.

FIG. 10 is a top view of the anti-rotational box 48 showing the placement of the thickened wall ribs 50, 52, 54, 56, 58 and 60 around the inner surface of the full-depth walls 12.

The results of testing show that containers stored and transported in a device incorporating the features of both the first and second embodiments of the anti-rotational system 48 can be reused approximately thirty times, even when a vertical load of approximately two tons is applied to the full-depth walls 12 of the anti-rotational system 48.

Obviously, numerous modifications and variations of the present invention are possible in light of the above teachings. It is therefore to be understood that within the scope of the appended claims, the invention may be practiced otherwise than as specifically described herein.

We claim:

1. A system for holding containers, comprising:

a structure for storing a container; and a plurality of pockets within said structure, wherein said plurality of pockets have a substantially rigid portion for engaging a first diameter of the container and an elastic means for engaging a second diameter of the container with a force selected to prevent rotation of the container in said structure.

2. The system according to claim 1, wherein said structure includes at least one wall configured to have a height at least as large as a predetermined height.

3. The system according to claim 2, further comprising a bottom structure connected to said at least one wall.

4. A system as recited in claim 3, wherein said substantially rigid portion includes pairs of perpendicular ribs connected to said structure, said pairs of perpendicular ribs connected to said bottom structure of said structure.

5. A system as recited in claim 4, wherein said pairs of perpendicular ribs are substantially located between said bottom structure and said elastic means.

6. A system as recited in claim 4, wherein said substantially rigid portion includes first sets of pairs of perpendicular ribs, each first set of pairs of perpendicular ribs formed by two substantially parallel pairs of perpendicular ribs, and second sets of pairs of perpendicular ribs, each second set of pairs of perpendicular ribs formed by two substantially parallel pairs of perpendicular ribs, said second sets of pairs of perpendicular ribs oriented in planes being substantially perpendicular to planes in which said first sets of pairs of perpendicular ribs exist.

7. A system as recited in claim 6, wherein said pairs of perpendicular ribs are substantially located between said bottom structure and said elastic means.

8. A system as recited in claim 4, wherein said elastic means includes longitudinal ribs connected to said structure.

9. A system as recited in claim 8, wherein said longitudinal ribs being located above said bottom structure and being substantially parallel to said bottom structure.

10. A system as recited in claim 9, wherein said elastic means includes first sets of longitudinal ribs, each first set of longitudinal ribs formed by two parallel facing longitudinal ribs, and second sets of longitudinal ribs, each second set of longitudinal ribs formed by two parallel facing longitudinal ribs, said second sets of longitudinal ribs oriented substantially transverse to said first sets of longitudinal ribs.

11. A system as recited in claim 10, further comprising at least one thickened wall rib connected to said at least one wall, said bottom structure and at least one of said plurality of pockets.

12. A system as recited in claim 10, further comprising at least four thickened wall ribs; wherein said at least one wall includes four walls; wherein each of said four thickened wall ribs extend substantially an entire height of each of said four walls; wherein a first thickened wall rib of said four thickened wall ribs being connected to a first wall of said four walls, said bottom structure and at least one of said plurality of pockets; wherein a second thickened wall rib of said four thickened wall ribs being connected to a second wall of said four walls, said bottom structure and at least one of said plurality of pockets; wherein a third thickened wall rib of said four thickened wall ribs connected to a third wall of said four walls, said bottom structure and at least one of said plurality of pockets; and wherein a fourth thickened wall rib of said four thickened wall ribs being connected to a fourth wall of said four walls, said bottom structure and at least one of said plurality of pockets.

13. A system as recited in claim 8, further comprising at least one thickened wall rib connected to said at least one wall, said bottom structure and at least one of said plurality of pockets.

14. A system as recited in claim 8, further comprising at least four thickened wall ribs; wherein said at least one wall includes four walls; wherein each of said four thickened wall ribs extend substantially an entire height of each of said four walls; wherein a first thickened wall rib of said four thickened wall ribs being connected to a first wall of said four walls, said bottom structure and at least one of said plurality of pockets; wherein a second thickened wall rib of said four thickened wall ribs being connected to a second wall of said four walls, said bottom structure and at least one of said plurality of pockets; wherein a third thickened wall rib of said four thickened wall ribs connected to a third wall of said four walls, said bottom structure and at least one of said plurality of pockets; and wherein a fourth thickened wall rib of said four thickened wall ribs being connected to a fourth wall of said four walls, said bottom structure and at least one of said plurality of pockets.

15. A system as recited in claim 4, further comprising at least one thickened wall rib connected to said at least one wall, said bottom structure and at least one of said plurality of pockets.

16. A system as recited in claim 4, further comprising at least four thickened wall ribs; wherein said at least one wall includes four walls; wherein each of said four thickened wall ribs extend substantially an entire height of each of said four walls; wherein a first thickened wall rib of said four thickened wall ribs being connected to a first wall of said four walls, said bottom structure and at least one of said plurality of pockets; wherein a second thickened wall rib of said four thickened wall ribs being connected to a second wall of said four walls, said bottom structure and at least one of said plurality of pockets; wherein a third thickened wall rib of said four thickened wall ribs connected to a third wall of said four walls, said bottom structure and at least one of said plurality of pockets; and wherein a fourth thickened wall rib of said four thickened wall ribs being connected to a fourth wall of said four walls, said bottom structure and at least one of said plurality of pockets.

17. A system as recited in claim 3, further comprising at least one thickened wall rib connected to said at least one wall, said bottom structure and at least one of said plurality of pockets.

18. A system as recited in claim 3, further comprising at least four thickened wall ribs; wherein said at least one wall includes four walls; wherein each of said four thickened wall ribs extend substantially an entire height of each of said four walls; wherein a first thickened wall rib of said four thickened wall ribs being connected to a first wall of said four walls, said bottom structure and at least one of said plurality of pockets; wherein a second thickened wall rib of said four thickened wall ribs being connected to a second wall of said four walls, said bottom structure and at least one of said plurality of pockets; wherein a third thickened wall rib of said four thickened wall ribs connected to a third wall of said four walls, said bottom structure and at least one of said plurality of pockets; and wherein a fourth thickened wall rib of said four thickened wall ribs being connected to a fourth wall of said four walls, said bottom structure and at least one of said plurality of pockets.

* * * * *